US008201684B2

(12) United States Patent
Torrellas

(10) Patent No.: US 8,201,684 B2
(45) Date of Patent: Jun. 19, 2012

(54) REUSABLE GARMENT BAG

(76) Inventor: Tonia P. Torrellas, Hicksville, NY (US)

( * ) Notice: Subject to any disclaimer, the term of this patent is extended or adjusted under 35 U.S.C. 154(b) by 177 days.

(21) Appl. No.: 12/686,254

(22) Filed: Jan. 12, 2010

(65) Prior Publication Data

US 2011/0168584 A1 Jul. 14, 2011

(51) Int. Cl.
*A45C 3/00* (2006.01)
*A45C 13/02* (2006.01)

(52) U.S. Cl. ..... 206/287; 206/279; 206/287.1

(58) Field of Classification Search ..... 206/287, 206/287.1, 279
See application file for complete search history.

(56) References Cited

U.S. PATENT DOCUMENTS

| | | | | | |
|---|---|---|---|---|---|
| 1,651,706 | A | | 12/1927 | Holbrook | |
| 2,132,337 | A | * | 10/1938 | Whiteman | 206/280 |
| 2,154,630 | A | * | 4/1939 | Marbury et al. | 190/111 |
| 2,325,806 | A | | 8/1943 | Simmons | |
| 2,596,412 | A | * | 5/1952 | Kish, Jr. et al. | 206/292 |
| 3,115,959 | A | * | 12/1963 | Jaffe | 206/287.1 |
| 3,612,232 | A | | 10/1971 | Larson | |
| 3,831,740 | A | * | 8/1974 | Pendergast et al. | 206/287 |
| 4,098,376 | A | | 7/1978 | Pelavin | |
| 4,189,036 | A | | 2/1980 | Pelavin | |
| 4,542,824 | A | | 9/1985 | Allen | |
| 5,002,183 | A | * | 3/1991 | Okano | 206/287 |
| 5,090,559 | A | * | 2/1992 | Gendreau | 206/278 |
| 5,320,220 | A | * | 6/1994 | Purkiss | 206/287.1 |
| 5,323,897 | A | * | 6/1994 | Sperber | 206/287 |
| 5,358,106 | A | | 10/1994 | King et al. | |
| 5,561,859 | A | * | 10/1996 | Fischer | 2/69.5 |
| 7,108,900 | B1 | | 9/2006 | Manning Porter | |
| 2006/0086628 | A1 | * | 4/2006 | Deutschendorf et al. | 206/287.1 |
| 2008/0264745 | A1 | * | 10/2008 | Tauchen | 190/111 |
| 2010/0224515 | A1 | * | 9/2010 | Siegel et al. | 206/279 |

FOREIGN PATENT DOCUMENTS

| | | | | |
|---|---|---|---|---|
| DE | 20312047 | | 10/2003 | |
| EP | 1.520.805 | | 4/2005 | |
| GB | 2.053.151 | | 2/1981 | |
| GB | 2243764 | A * | 11/1991 | 206/287.1 |
| WO | WO87/02561 | | 5/1987 | |

* cited by examiner

*Primary Examiner* — Sue Weaver
(74) *Attorney, Agent, or Firm* — Michael I. Kroll

(57) ABSTRACT

A reusable garment bag having a first interior compartment, an open bottom, a closed top with an opening sized to allow passage therethrough of hanger tops, a front having a generally vertical slit sealably closed with a zipper, a back having an opening providing access to a second interior compartment segregated from the first interior compartment, a drawstring circumscribing a hem about the open bottom, an elastic strap in the first interior compartment, a handle affixed to the top and bottom, and a strap adapted to secure the two handles together for carrying the garment bag in a folded orientation.

17 Claims, 12 Drawing Sheets

REUSABLE GARMENT BAG

BACKGROUND OF THE INVENTION

1. Field of the Invention

The present invention relates generally to garment bags and, more specifically, to a garment bag for processing apparel by a user. The garment bag of the present invention is used to transport apparel between a user and a cleaning service. The user stores their cleaned apparel from the cleaning service within a zippered compartment of the garment bag and when soiled places the soiled apparel within an open compartment, which is segregated from the zippered compartment, and when desired takes the garment bag with the soiled apparel back to the cleaning service for cleaning and again places cleaned apparel within the zippered compartment thereby forming a cycle for processing apparel. The present invention also provides a front side pocket for placement therein of a desired document, such as a receipt from the cleaners, and further provides a name tag pocket located under the document pocket.

The back side of the garment bag has an open compartment serving as a hamper for soiled clothes with a strap and buckle extending between the top end of the garment bag and the open compartment forming latch for keeping the open compartment opening somewhat closed that can be unlatched to deposit soiled clothes therein. Also shown is a hook and loop strap positioned on the bottom portion of the bag and another fastened to the bag carrying handle providing means for securely holding the bag in a folded state when desired and having another handle on the bottom of the bag for carrying the bag in a folded state.

The present invention also provides a back side compartment with material that extends approximately from the center to the bag seam leaving a left and right opening for inserting soiled clothes.

The present invention further envisions that the soiled clothes compartment can have interior pockets located on the front or back wall of the soiled clothes compartment when the garment bag is used by the clothing rental industry, such as tuxedo and gown rental for the storage of shoes and speciality apparel, such as gown veil.

2. Description of the Prior Art

There are other garment bags designed for storing apparel. While garment bags may be suitable for the purposes for which they were designed, they would not be as suitable for the purposes of the present invention, as hereinafter described.

Therefore it is felt that a need exists for a garment bag that can be reused for storing cleaned clothes therein and soiled clothes segregated from said cleaned clothes with the alternate provision of additional pockets positioned on either interior wall of the soiled clothes compartment serving the apparel rental industry including uniform, tuxedo and gown rental, which may include footwear or speciality apparel items.

SUMMARY OF THE PRESENT INVENTION

The present invention is a reusable garment bag that is intended for transporting dirty and receiving clean clothes to and from the dry cleaners. The main purpose is to bring to markets product that is customer and service provider friendly. Thereby, bringing a "Green" alternative to the dry cleaning industry. However, what has been discovered during the sample process is that the list of alternative applications is limitless.

The basic design appears like a traditional all enclosed garment bag with a bottom-up front zipper access and style. What is unique is the creation of a separate compartment for dirty clothes from the area reserved for receiving clean clothes in. The use of a sturdy yet pliable vinyl gives the visual benefit disposable plastic dry cleaners provide. The vinyl may be transparent or translucent. Then incorporated is a durable and breathable nylon that is already being used in laundry bags. In addition to expandable side "Vented Gussets". This allows for it to work equally as well with just one or quite a few articles of clothing. The venting helps to enhance the air flow of the bag. The bag is then finished off with some well positioned carry handles, inner elastic strap to hold the bottoms of the clothes during transport and then topped off with a means of securing the hanger necks; much in the way the current wire twist tie would. All of this is obtained within the confines of this "single item". Without any detachable pieces; thereby, the consumer will not have to worry about forgetting anything.

A primary object of the present invention is to provide an Earth Friendly "Green" reusable garment bag.

Another object of the present invention is to provide a reusable garment bag incorporating a "breathable" fabric and well ventilated opening, which is beneficial to the consumer.

Yet another object of the present invention is to provide a reusable garment bag for processing apparel between a user and a cleaning service.

Still yet another object of the present invention is to provide a reusable garment bag for processing apparel between an apparel rental agency and a renting user.

An additional object of the present invention is to provide a reusable garment bag for gathering soiled clothes at home then transporting the same to a cleaning service and receiving said clothes back in the very same bag leaves little room for error.

A further object of the present invention is to provide a reusable garment bag that can be used for apparel storage.

A yet further object of the present invention is to provide a reusable storage bag that can be used for storage of apparel during travel enabling separation of soiled apparel from clean apparel.

A still yet further object of the present invention is to provide a reusable garment bag having a compartment for cleaned clothes and a compartment for soiled clothes.

Another object of the present invention is to provide a reusable garment bag wherein said compartment for cleaned clothes has a zipper providing easy access by the cleaning service and the user.

Yet another object of the present invention is to provide a reusable garment bag that helps the user by having a definite place to collect the items.

Still yet another object of the present invention is to provide a reusable garment bag wherein the compartment for soiled clothes is positioned on the back side of the garment bag and segregated from the cleaned clothes compartment.

An additional object of the present invention is to provide a reusable garment bag wherein said soiled clothes compartment is an open compartment.

A further object of the present invention is to provide a reusable garment bag wherein said soiled clothes compartment has a transverse belt and latch extending thereacross keeping the compartment in a somewhat closed state that can be selectively unlatched to place soiled clothes therein.

A yet further of the present invention is to provide a reusable garment bag having a top end handle and a bottom end handle whereby said garment bag can be ported in a folded or unfolded state.

A still yet further object of the present invention is to provide a reusable garment bag wherein said top end handle has a hook and loop strap providing means for securing the top and bottom handles together.

Another object of the present invention is to provide a reusable garment bag having a hanger strap for binding a plurality of hangers together.

Yet another object of the present invention is to provide a strap within the cleaned clothes compartment for securing the bottom portion of longer garments, such as dresses and gowns.

Still yet another object of the present invention is to provide a garment bag having a transparent or translucent pocket for storing a document therein, such as a cleaning receipt.

An additional object of the present invention is to provide a reusable garment bag providing a pocket for a name tag.

A further object of the present invention is to provide a reusable garment bag that can be tri-folded with an exterior strap for securing hanger necks therein.

A yet further object of the present invention is to provide a reusable garment bag wherein said front zippered compartment is open along the bottom having a hem with a drawstring therein for cinching the bag closed when desired.

A still yet further object of the present invention is to provide alternate openings to the soiled clothes compartment on either the side or bottom.

Additional objects of the present invention will appear as the description proceeds.

The present invention overcomes the shortcomings of the prior art by providing a reusable garment bag for processing apparel by a user and a cleaning service. The user stores their cleaned apparel from the cleaning service within a zippered compartment of the garment bag and when soiled places the soiled apparel within an exterior backside open compartment, which is thereby segregated from the zippered compartment, and when desired the user takes the garment bag with the soiled apparel back to the cleaning service for cleaning and again places cleaned apparel within the zippered compartment thereby forming a cycle for processing apparel. The present invention also provides a front side pocket for placement therein of a desired document, such as a receipt from the cleaners and a subjacent pocket for a name tag.

Furthermore, the reusable garment bag can be used for apparel storage and for travel.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
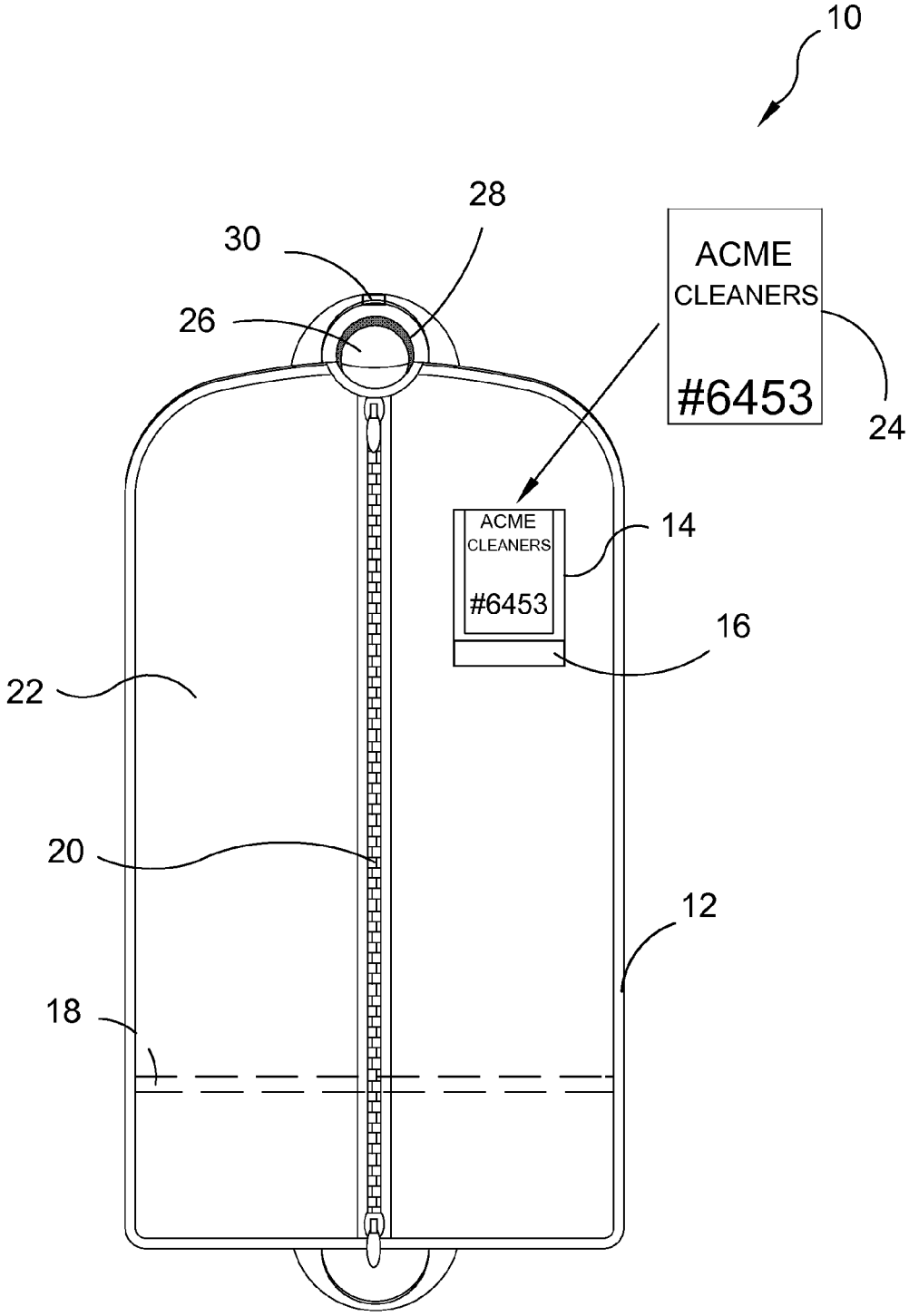
FIG. 1 is a front view of the garment bag of the present invention.

Turning now descriptively to the drawings, in which similar reference characters denote similar elements throughout the several views, the figures illustrate the Reusable Garment Bag of the present invention. With regard to the reference numerals used, the following numbering is used throughout the various drawing figures.

10 reusable garment bag of the present invention
12 garment bag
14 document pocket
16 customer information tag
18 apparel securing strap
20 zipper
22 zippered first compartment
24 receipt
26 access opening
28 top carrying handle
30 top carrying handle fastener
32 open soiled clothes second compartment
34 strap
36 buckle
44 tri-fold handle strap
46 bottom handle
48 gusset
50 vent
52 cleaned garment
54 hanger hook securing strap
56 hanger hook
58 soiled clothes
60 hook and loop strap
62 open bottom of 22
64 drawstring
66 closed base of 32
68 soiled clothes aperture

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a front view of the reusable multi-compartmented garment bag of the present invention 10. The present invention 10 provides a garment bag 12 for processing apparel by a user. The garment bag 12 is used to transport apparel between a user and a cleaning service. The user stores their cleaned apparel from the cleaning service within a zippered 20 compartment 22 of the garment bag 12 and when soiled places the soiled apparel within an open compartment, which is segregated from the first, and when desired takes the garment bag with the soiled apparel back to the cleaning service to be cleaned and again places cleaned apparel within the zippered compartment thereby forming a cycle for processing apparel. The present invention also provides a pocket 14 for placement therein of a desired document, such as a receipt 24 from the cleaners. Optionally provided is a customer name tag pocket 16 and interior apparel securing strap 18. Further included is a wide access opening 26 formed by multi-hanger carrying handle 28 which is secured by a multi-hanger fastener 30.

Figure 2:
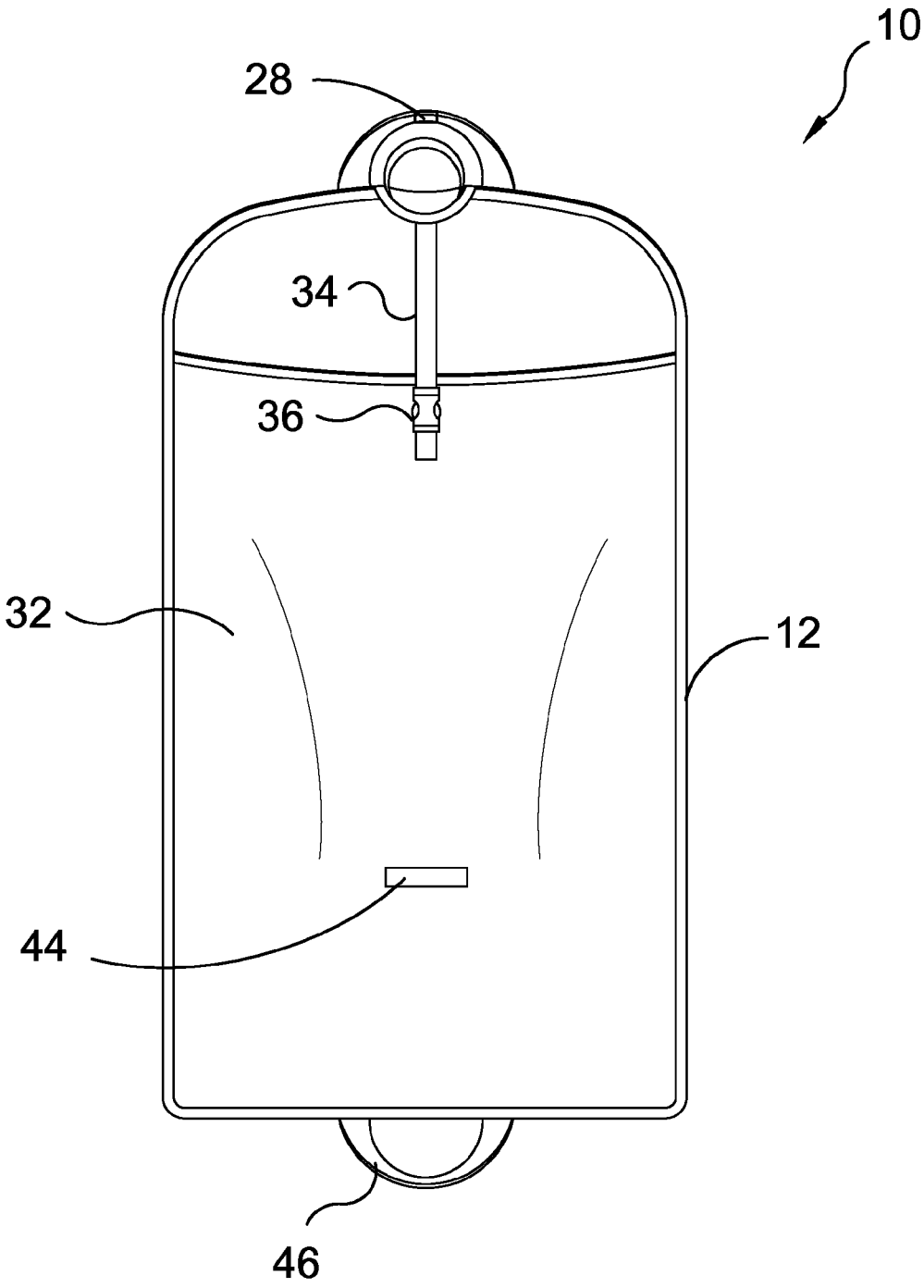
FIG. 2 is a back view of the garment bag of the present invention.

FIG. 2 is a back view of the garment bag of the present invention 10. Shown is a back view of the garment bag 12 having an open soiled clothes compartment 32 serving as a hamper for soiled clothes with a strap 34 and buckle 36 extending between the top end of the garment bag and the open compartment forming latch for keeping the open compartment 32 opening somewhat closed that can be unlatched to deposit soiled clothes therein. Included is a bottom handle 46 on the bottom of the bag for carrying the bag in a folded state. Also shown is a tri-fold hanger strap 44.

Figure 3:
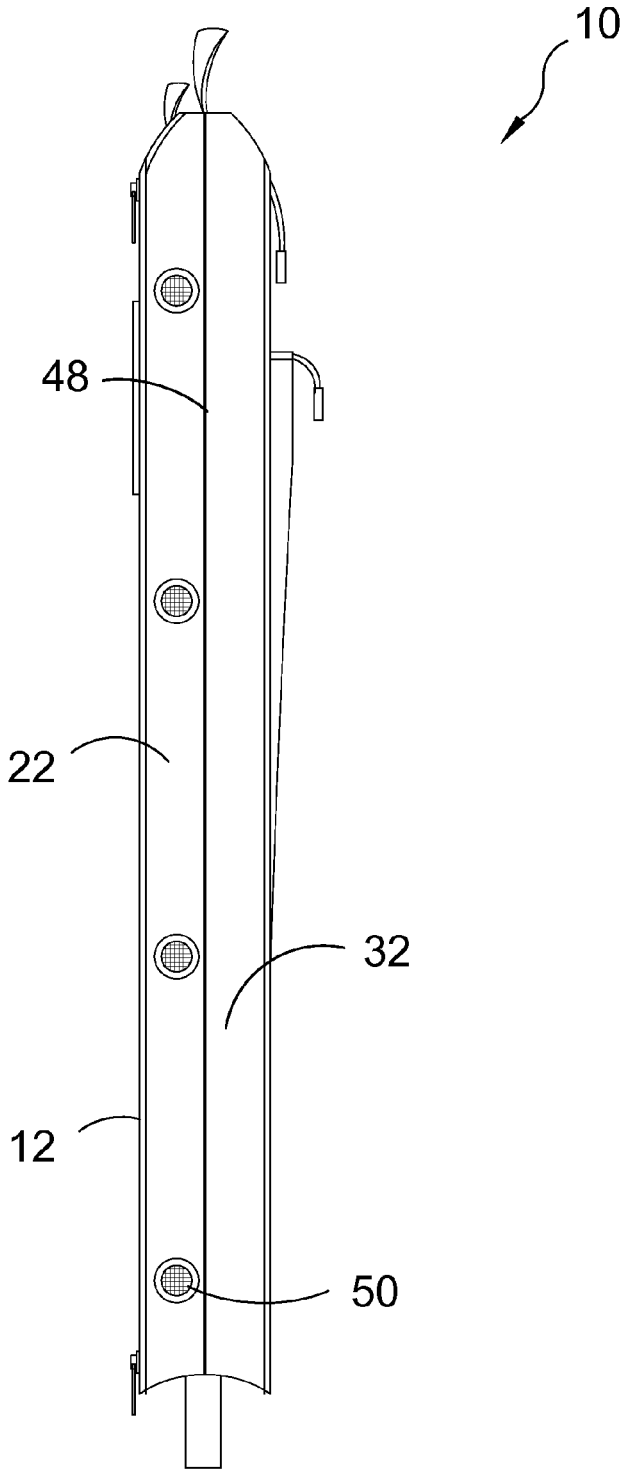
FIG. 3 is a side view of the garment bag of the present invention.

FIG. 3 is a side view of the garment bag of the present invention 10. Shown is a side view of the garment bag 12 having a zippered first compartment 22 and a second segregated open compartment 32. The sides have gussets 48 to provide expandability to accommodate more garments and includes vents 50 for the first compartment 22.

Figure 4:
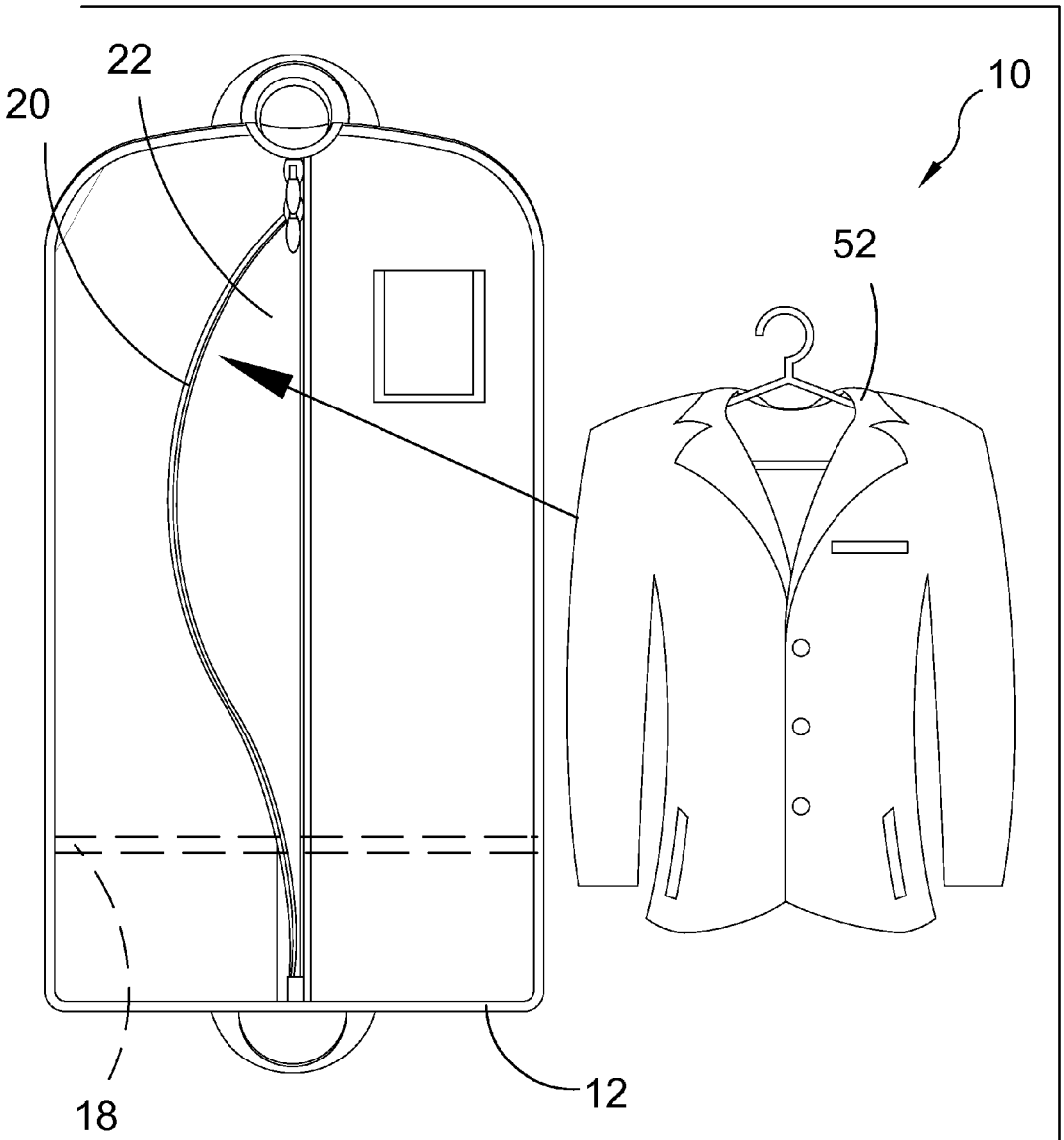
FIG. 4 is a front view of the garment bag of the present invention in use.

FIG. 4 is a front view of the garment bag 12 of the present invention 10 in use. Shown is the zipper 20 of the first compartment 22 open to receive cleaned garments 52 therein. Also shown is the optional apparel securing strap 18.

Figure 5:
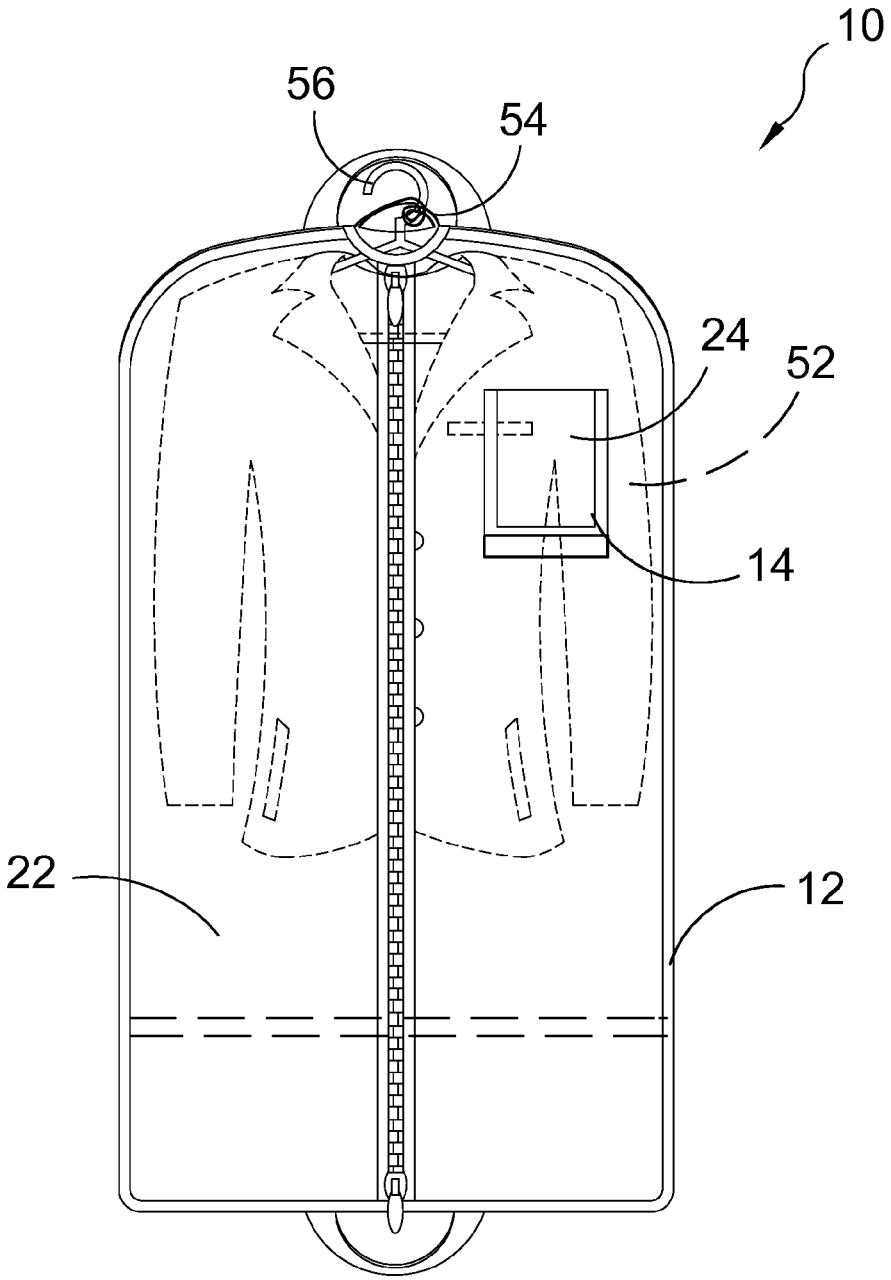
FIG. 5 is a front view of the garment bag of the present invention in use.

FIG. 5 is a front view of the garment bag 12 of the present invention 10 in use. Shown is cleaned apparel 52 from the cleaning service stored within a zippered compartment 22 of the garment bag and when soiled will be placed within an open back side compartment, which is segregated from the first, and when desired the user takes the garment bag with the soiled apparel back to the cleaning service to be cleaned and again places cleaned apparel within the zippered compartment thereby forming a cycle for processing apparel. The present invention also provides a pocket 14 for placement therein of a desired document, such as a receipt 24 from the cleaners. The hanger tops 56 are held together by twist tie hanger top securing straps 54.

Figure 6:
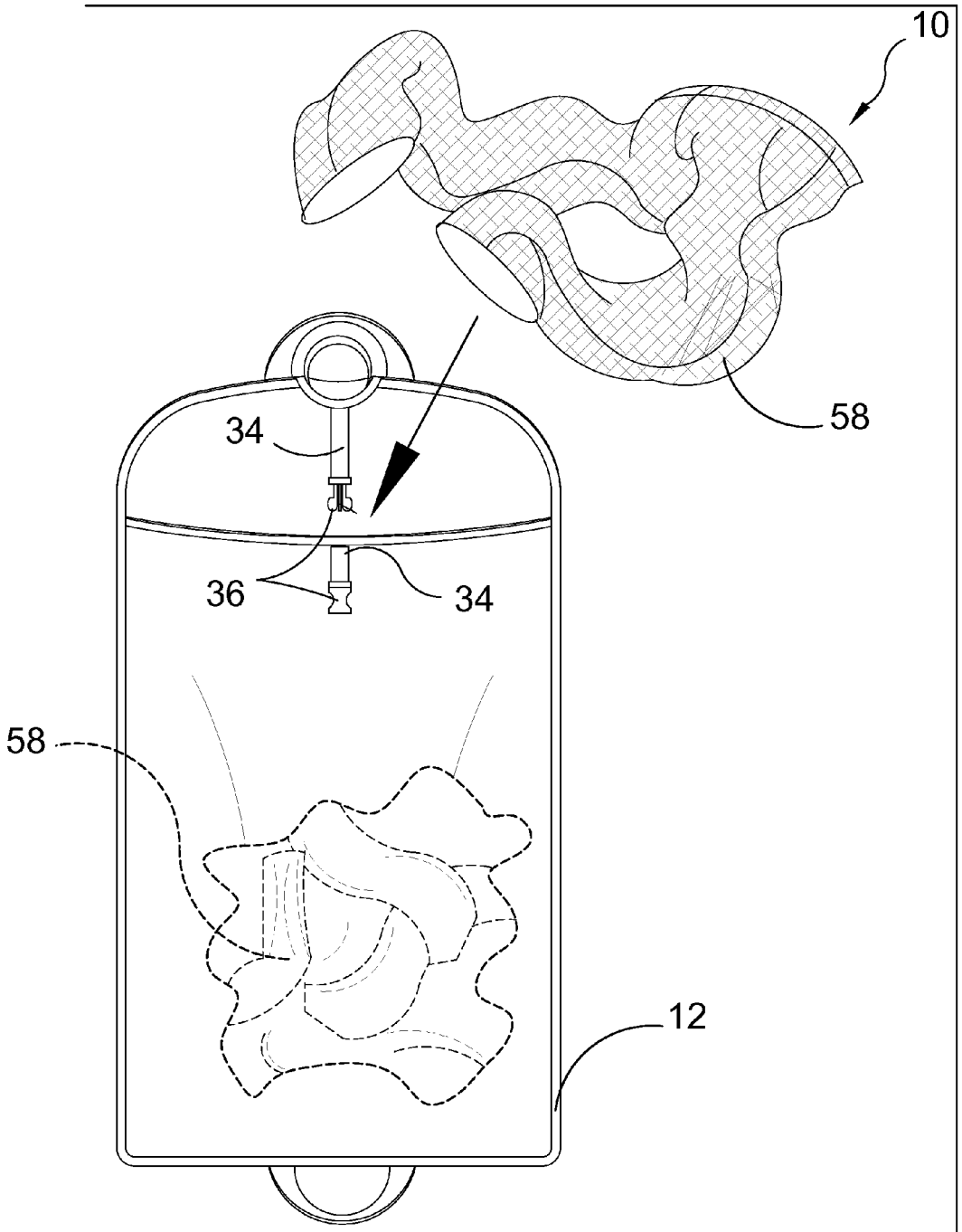
FIG. 6 is an illustrative view of the back side of the garment bag in use.

FIG. 6 is an illustrative view of the back side of the garment bag 12 of the present invention 10 in use. Shown are soiled clothes 58 placed within the open back second compartment 32 serving as a hamper for soiled clothes, which are segregated from the clean clothes within the zippered compartment. When desired the user takes the garment bag 12 with the soiled apparel 58 back to the cleaning service to be cleaned and again places cleaned apparel within the zippered compartment thereby forming a cycle for processing apparel. The second compartment is partially closed when the straps 34 and buckles 36 are fastened.

Figure 7:
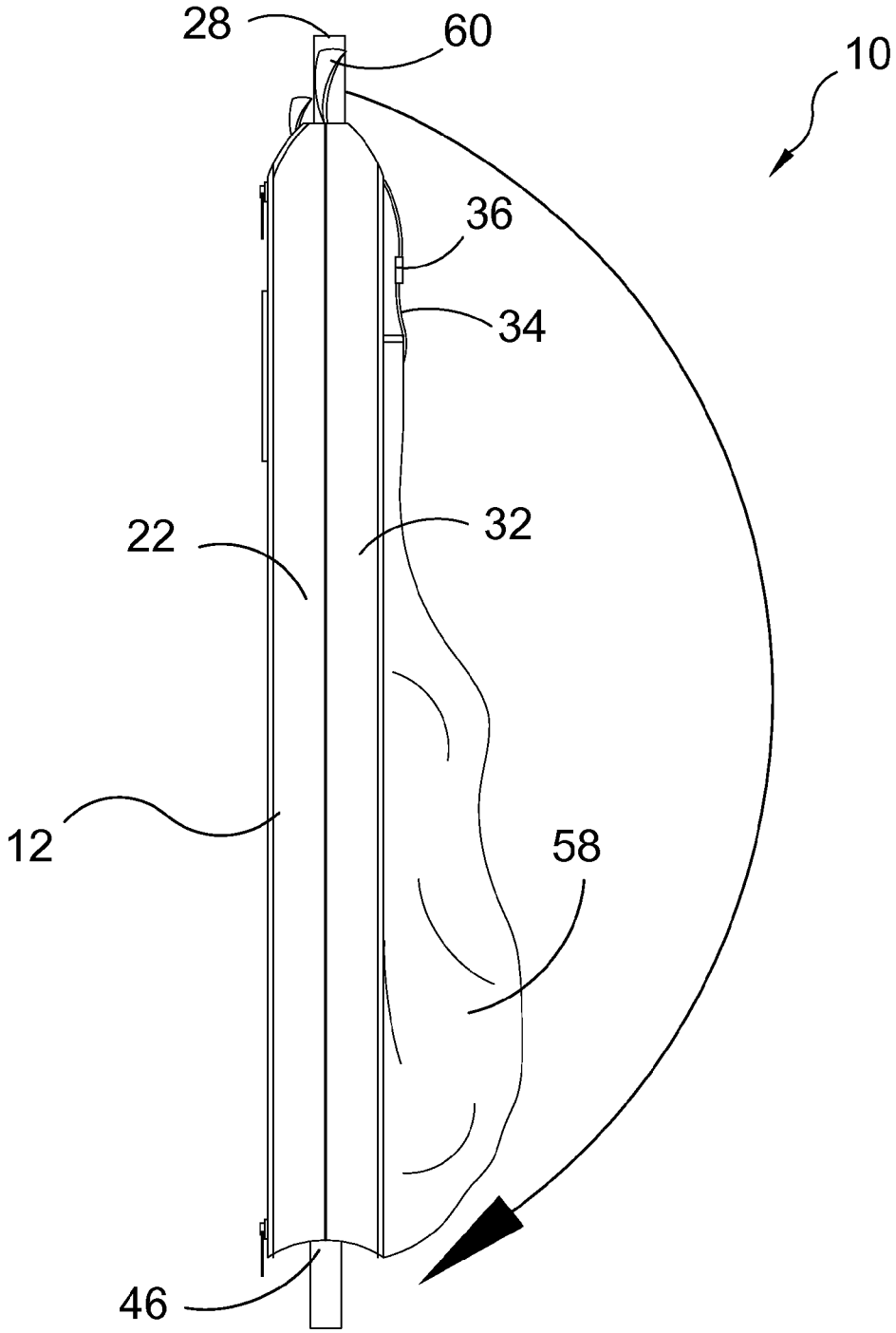
FIG. 7 is a side view of the garment bag of the present invention in use.

FIG. 7 is a side view of the garment bag 12 of the present invention 10 in use. Shown is a side view of the garment bag 12 having a zippered first compartment 22 and a second segregated open compartment 32 with soiled clothes 58 therein. Also shown is a strap 34 and buckle 36 keeping the second compartment 32 closed. The garment bag 12 further provides a top end handle 28 and a bottom end handle 46 providing means for carrying the garment bag in an unfolded or folded state with the top handle having a hook and loop strap 60 for securing the two handles together while in a folded state.

Figure 8:
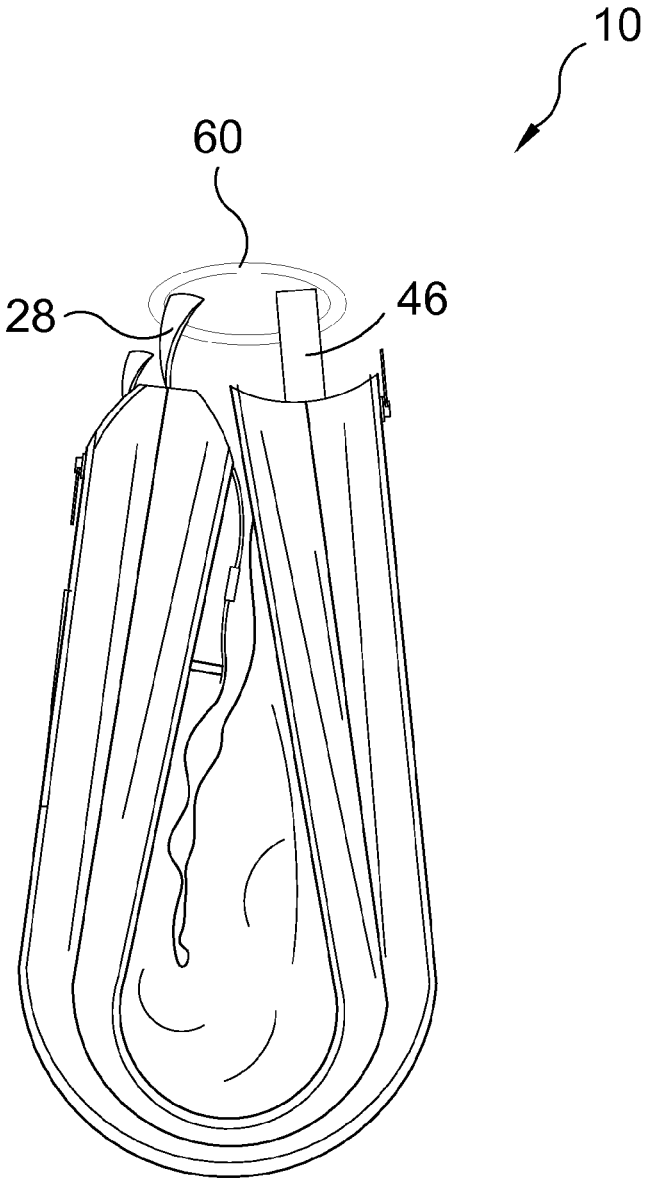
FIG. 8 is a side view of the garment bag in a folded state.

FIG. 8 is a side view of the garment bag 12 of the present invention 10 in a folded state. Shown is a side view of the garment bag in a folded state having soiled clothes therein. The garment bag further provides a top end handle 28 and a bottom end handle 46 providing means for carrying the garment bag in a folded state with the top handle 28 having a hook and loop strap 60 for securing the two handles together while in the folded state.

Figure 9:
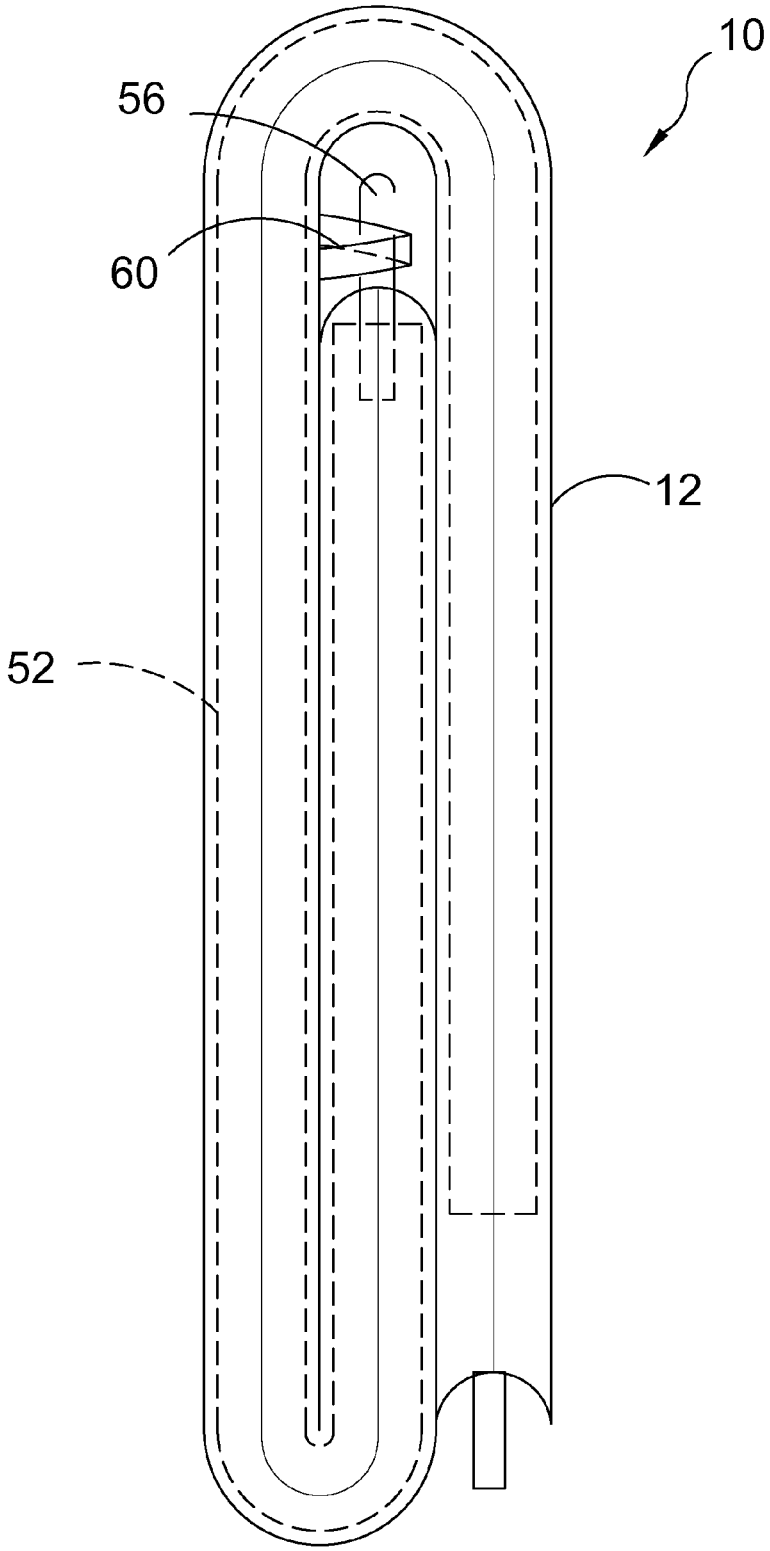
FIG. 9 is a side view of the garment bag in a tri-folded state.

FIG. 9 is a side view of the garment bag 12 of the present invention 10 in a tri-folded state. Shown is a side view of the garment bag in a tri-folded state with clean hangered garments 52 having a hook and loop strap 60 for securing hanger hooks 56 to the body of the bag 12.

Figure 10:
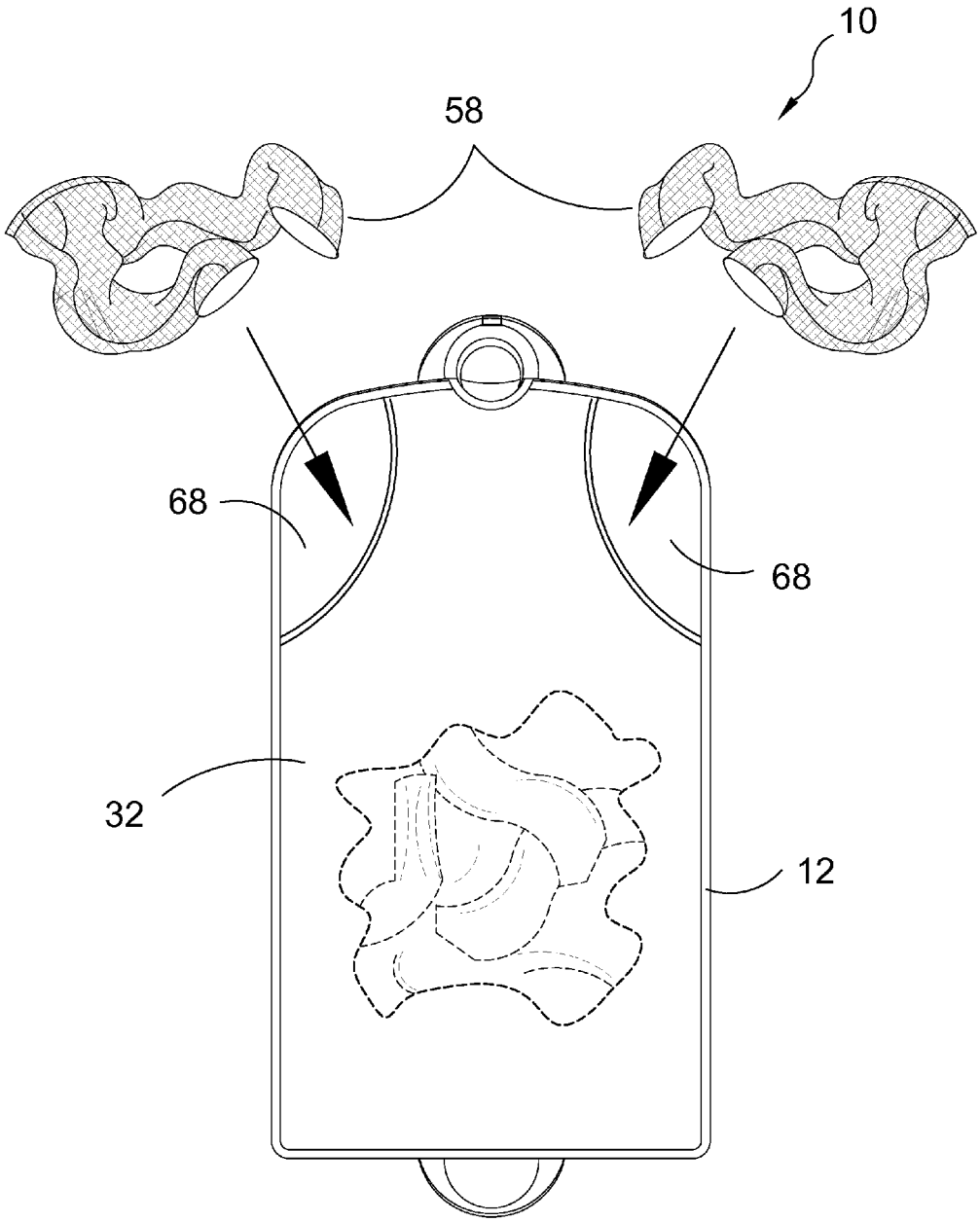
FIG. 10 is a back view of an alternate apertured soiled clothes compartment of the present invention.

FIG. 10 is a back view of an alternate apertured soiled clothes compartment 32 of the present invention 10. Shown is a back view of the garment bag 12 wherein the open soiled clothes compartment 32 extends and is secured approximate the center of the top hem with left and right apertures 68 for depositing soiled clothes 58 therein.

Figure 11:
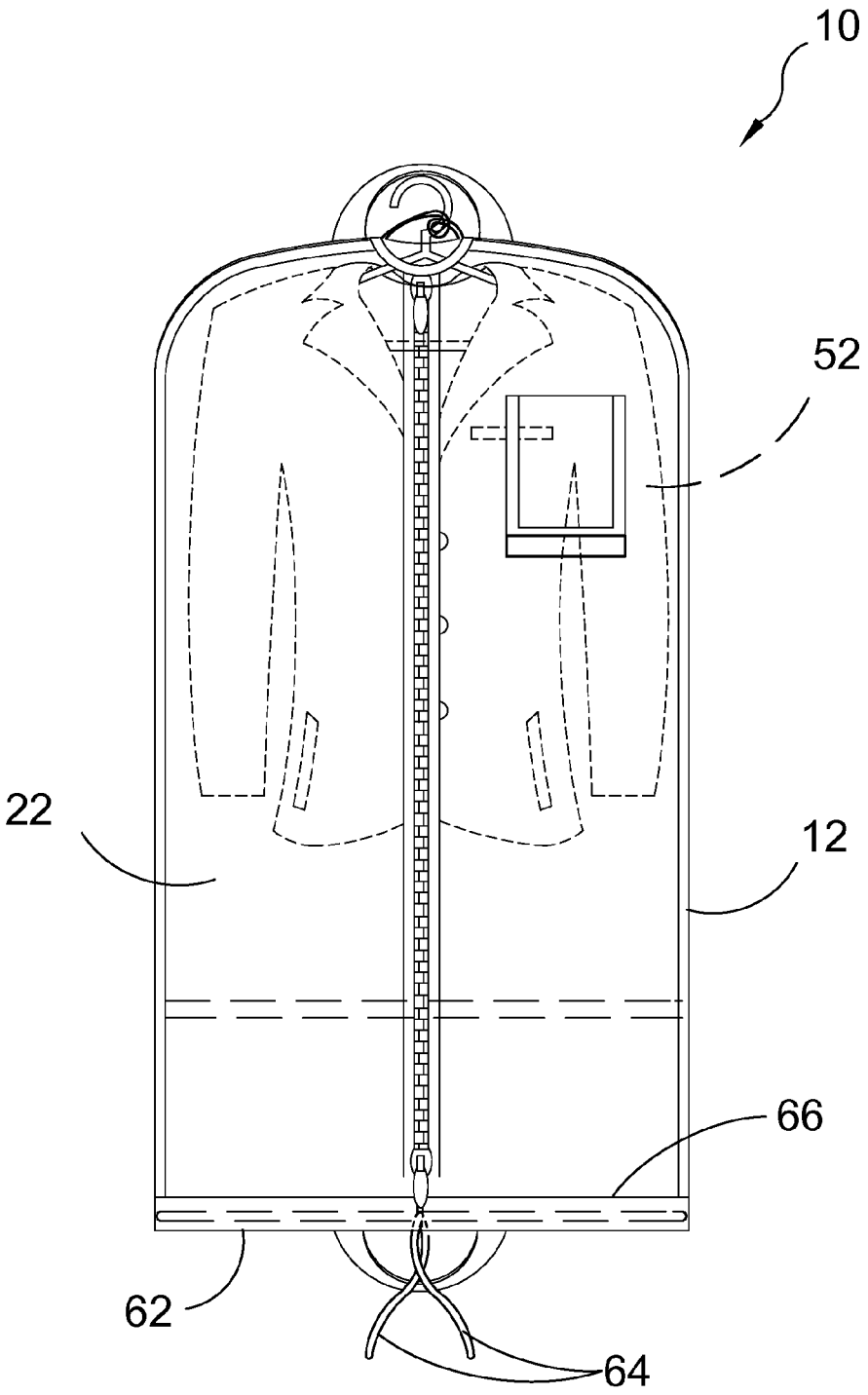
FIG. 11 is a front view of the garment bag of the present invention having a cinchable open bottom.

FIG. 11 is a front view of the garment bag 12 of the present invention 10 having a cinchable open bottom 62. The present invention provides a garment bag having an open bottom 62 for the zippered cleaned clothes compartment 22 with the open back side soiled clothes compartment closed along the base 66. The open bottom 62 provides an alternate opening for the cleaning service by providing for the bag to be slipped over the cleaned clothes from top to bottom without having to open the front zipper. Wherethen the cleaned clothes compartment is preferably cinched closed from the back side with a drawstring 64. Such a design would be advantageous when the cleaned clothes 52 are hanging from a stanchion hook.

Figure 12:
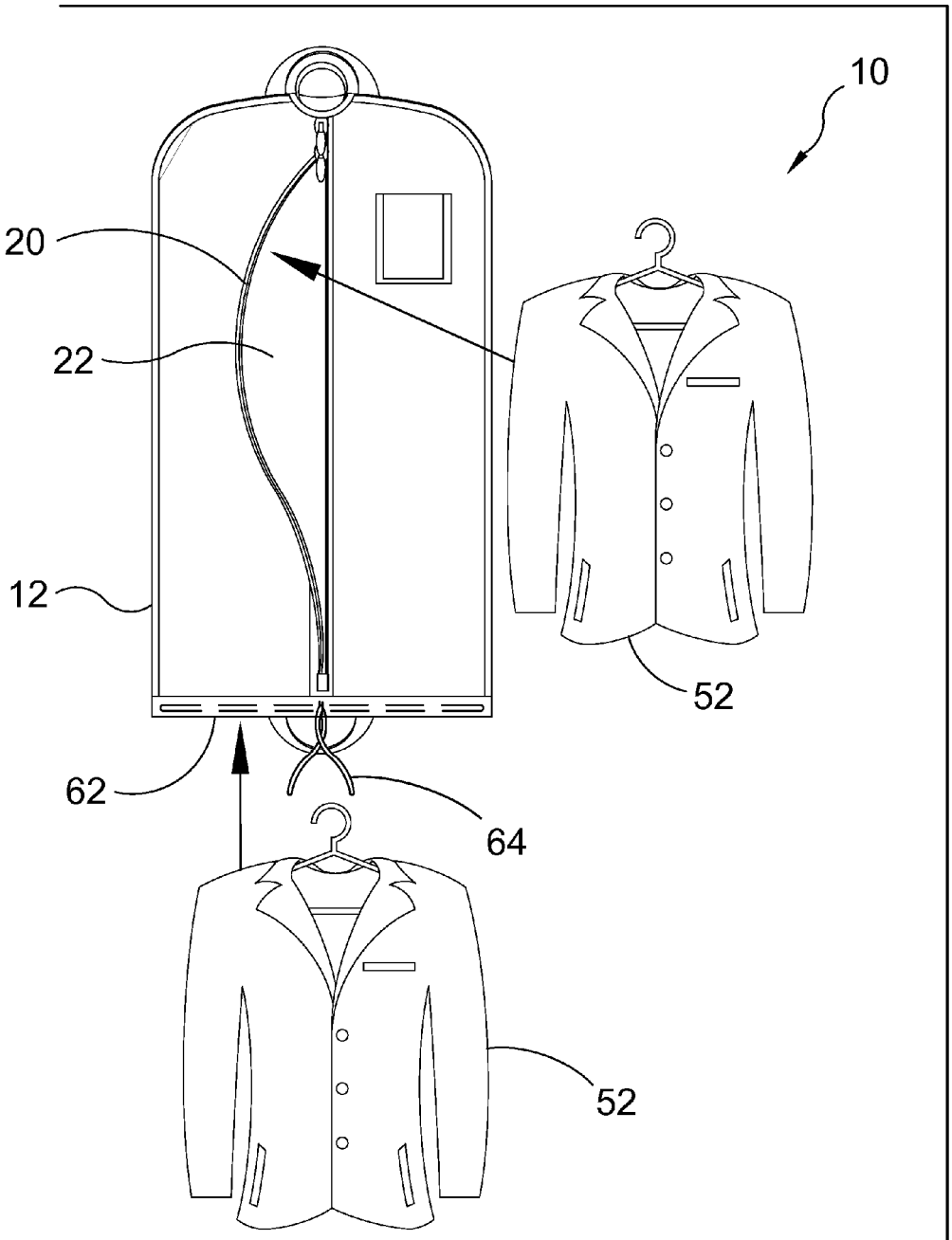
FIG. 12 is a front view of the garment bag of the present invention in use having a cinchable open bottom.

FIG. 12 is a front view of the garment bag 12 of the present invention 10 in use having a cinchable open bottom 62. The present invention 10 envisions a garment bag 12 having a front compartment 22 with access for inserting cleaned clothes by opening the zipper 20 and/or by having an open bottom 62 with a draw string 64 preferably cinchable from the back side forming closure. The open cinchable bottom provides an alternate opening for the cleaning service by providing for the bag to be slipped over the cleaned clothes 52 from top to bottom without having to open the front zipper, wherethen the cleaned clothes compartment 22 is closed by means of the drawstring 64.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A reusable garment bag comprising:

a) a first interior compartment;

b) a closed top with an opening sized to allow passage therethrough of hanger tops, a bottom opposite said top, a handle affixed to said top and a handle affixed to said bottom;

c) a front having a generally vertical slit sealably closed with a zipper;

d) a back having an opening providing access to a second interior compartment segregated from said first interior compartment, said second interior compartment being sealed at said bottom; and e) said opening in said back comprises a transverse belt and latch extending across said opening.

2. The reusable garment bag according to claim 1, further comprising expandable side gussets.

3. The reusable garment bag according to claim 2, wherein said expandable side gussets are vented.

4. The reusable garment bag according to claim 1, further comprising an elastic strap in said first interior compartment.

5. The reusable garment bag according to claim 1, further comprising a hanger strap proximate said opening in said top.

6. The reusable garment bag according to claim 1, further comprising a hook and loop fastener strap adapted to secure said top and bottom handles together.

7. The reusable garment bag according to claim 1, further comprising two pockets affixed to an exterior surface of said front of said garment bag, one of said sockets being larger than the other.

8. The reusable garment bag according to claim 1, formed of a breathable sheet material.

9. The reusable garment bag according to claim 1, wherein said reusable garment bag is made of vinyl.

10. The reusable garment bag according to claim 9, wherein said material is transparent or translucent.

11. A reusable garment bag comprising:

a) a first interior compartment;

b) a closed top with an opening sized to allow passage therethrough of hanger tops, a bottom opposite said top;

c) a front having a generally vertical slit sealably closed with a zipper;

d) a back having an opening providing access to a second interior compartment segregated from said first interior compartment, said second interior compartment being sealed at said bottom;

e) an elastic strap in said first interior compartment f) a handle affixed to said top;

g) a handle affixed to said bottom;

h) a strap adapted to secure said top and bottom handles together; and i) wherein said opening in said back leading into said second compartment is partially closed b a transverse belt and latch extending across said opening in said back.

12. The reusable garment bag according to claim 11, further comprising expandable side gussets.

13. The reusable garment bag according to claim 11, further comprising a hanger strap proximate said opening in said top.

14. The reusable garment bag according to claim 13, further comprising a pair of pockets affixed to an exterior surface of said front of said garment bag, where one of said pair of pockets is larger than the other of said pair.

15. A method of transporting clothing comprising the steps:

a) providing a reusable garment bag having a first interior compartment with an open bottom, a closed top with an opening sized to allow passage therethrough of hanger tops, a front having a generally vertical slit sealably closed with a zipper, a back having an opening providing access to a second interior compartment segregated from said first interior compartment, a drawstring circumscribing a hem about said open bottom of said first compartment, an elastic strap in said first interior compartment, a handle affixed to said top, a handle affixed to said bottom, and a strap adapted to secure said top and bottom handles together;

b) unzipping said zipper to provide access to said first interior compartment;

c) placing cleaned clothes on hangers in said first interior compartment;

d) zipping said zipper closed;

e) folding said garment bag and enclosed garments generally in half;

f) strapping said top and bottom handles together; and g) carrying said garment bag by said handles.

16. The method according to claim 15, further comprising the step of placing soiled clothing items in said second interior compartment.

17. The method of claim 15, wherein said opening in said back leading into said second compartment is partially closed by a transverse belt and latch extending across said opening in said back.

* * * * *